United States Patent [19]

Nakamura et al.

[11] 3,973,541

[45] Aug. 10, 1976

[54] GOVERNOR FOR USE IN FUEL INJECTION PUMP

[75] Inventors: Yoshiatsu Nakamura, Ohimya; Hisato Nozawa, Oyama; Takuji Isomura; Katsuyuki Nakagawa, both of Kariya, all of Japan

[73] Assignee: Kabushiki Kaisha Komatsu Seisakusho, Tokyo, Japan

[22] Filed: May 29, 1974

[21] Appl. No.: 474,226

[30] Foreign Application Priority Data

May 30, 1973 Japan ..... 48-59661

[52] U.S. Cl. ..... 123/140 R

[51] Int. Cl.[2] ..... F02D 1/04

[58] Field of Search ..... 123/140 R

[56] References Cited

UNITED STATES PATENTS

| | | | |
|---|---|---|---|
| 2,987,056 | 6/1961 | Catford et al. | 123/140 R |
| 3,577,968 | 5/1971 | Staudt et al. | 123/140 R |
| 3,620,199 | 11/1971 | Kuhn et al. | 123/140 R |
| 3,672,343 | 6/1972 | Biechl et al. | 123/140 R X |
| 3,791,362 | 2/1974 | Nakamura et al. | 123/140 R |
| 3,797,470 | 3/1974 | Beck | 123/140 R |
| 3,847,126 | 11/1974 | Dreisin | 123/140 R |

FOREIGN PATENTS OR APPLICATIONS

| | | | |
|---|---|---|---|
| 788,497 | 1/1958 | United Kingdom | 123/140 R |
| 833,318 | 4/1960 | United Kingdom | 123/140 R |

*Primary Examiner*—Charles J. Myhre
*Assistant Examiner*—Tony M. Argenbright
*Attorney, Agent, or Firm*—Armstrong, Nikaido & Wegner

[57] ABSTRACT

A governor for use in a fuel injection pump for controlling the fuel control rod of such a fuel injection pump wherein the fulcrum of the lever connected to the fuel control rod is moved after the fuel control rod follows the movement of the lever only on a part of the accelerating travel when the accelerator lever is abruptly operated, and thus sharp increases in the amount of fuel injection are prevented so as to preclude the exhausting of black smoke from the engine.

7 Claims, 5 Drawing Figures

GOVERNOR FOR USE IN FUEL INJECTION PUMP

This invention relates to a governor for use in an internal combustion engine, and more particularly to a governor for use in a fuel injection pump for a diesel engine useful for preventing generation of black exhaust when the engine is accelerated.

In a fuel injection pump for supplying fuel to the diesel engine, controlling the amount of fuel injection is usually accomplished by means of a governor operated in response to the rotating speed and the load of the engine so as to supply fuel to the engine in such an amount as to meet the operating conditions of the engine.

However, it is known in conventional governors that when an accelerator lever is suddenly operated in the position or direction of accelerating the engine so as to accelerate the engine, the governor itself operates to quickly increase the amount of fuel injection of the fuel injection pump so that fuel in excess of required amount is abruptly supplied to the engine with the result that the engine exhausts black smoke. However, minimum required amounts of fuel injection are predetermined so as to ensure enough output at low and intermediate speeds, and thus countermeasures are not taken against the black smoke which tends to generate upon quick acceleration of the engine.

It is, therefore, an object of the present invention to provide a governor for use in a fuel injection pump for a diesel engine which can operate to prevent the engine from exhausting black smoke when it is accelerated and can still operate normally under other operating conditions.

It is another object of the present invention to provide a governor for use in a fuel injection pump for a diesel engine which can be easily obtained by improving the conventional governor in a simple manner. The governor according to the present invention is characterized in that its structure or arrangement is made such that when the accelerator lever is quickly operated in the position or direction of acceleration and upon accelerating the engine, the fuel control rod follows the movement of a floating lever only on a part of the accelerating travel and thereafter the fulcrum of the floating lever connected to the fuel control rod is shifted thereby to provide a time delay for the operation of the fuel control rod, and thus a quick increase in the amount of fuel to be injected is prevented so as to preclude the exhausting of black smoke by the engine upon acceleration. Further, the governor can operate normally during other operating conditions of the engine.

These and other objects, features and advantages of the governor of the present invention will become more apparent from the following description taken in conjunction with the accompanying drawings, in which.

Figure 1:
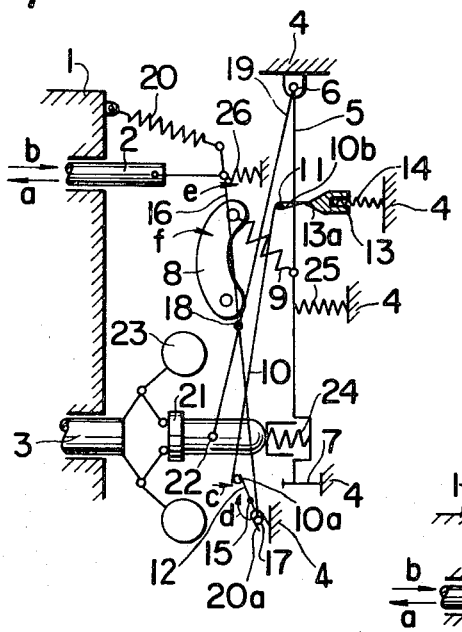
FIG. 1 is a schematic view of one embodiment of the governor of the invention.

Referring now to the drawings, reference numeral 1 indicates the body of a fuel injection pump, which contains a plunger (not shown) therein, and wherein fuel is delivered under pressure by the reciprocal movement of the plunger so as to supply fuel under pressure through a fuel injection valve (not shown) into an engine (not shown). Reference numeral 2 denotes a fuel control rod of the fuel injection pump, one end of which projects out of the pump body 1, and the other end (not shown) of which is engaged with a plunger within the pump body so as to rotate the plunger by the movement of the rod in the directions as shown by arrow *a* and *b* in order to control the amount of fuel to be injected by the fuel injection pump. When the fuel control rod 2 is moved in the direction as shown by arrow *a*, the amount of fuel injected is increased, while when the rod 2 is moved in the opposite direction as shown by arrow *b*, the amount of fuel injected is reduced.

Reference numeral 3 illustrates a cam shaft which passes through the fuel injection pump body 1. One end of the cam shaft is driven by the crankshaft of the engine and is thus rotated, thereby causing reciprocal movement of the plunger within the pump body. Reference numeral 4 denotes a governor body, 5 a rocking lever which is rotatably carried and suspended at the upper end thereof by means of a pin 6 fixed to the governor body 4, and the lower end thereof faces opposite to a full load stopper 7 secured in a fixed fashion to the governor body 4, and thus the rotation of the rocking lever in the counter clockwise direction in the drawing is limited. A governing spring 9 is extended in tension between the intermediate portion of the rocking lever 5 and a lever 8 which is connected to the accelerator lever of the engine (not shown), and the rocking lever 5 is placed in tension to the left in the drawing. The tension of the governing spring 9 can be varied by rotating the lever 8, connected to the accelerator lever.

Reference numeral 10 represents an auxiliary lever which is rotatably held at the upper end therof by a fulcrum 11 secured to the governor body 4. The auxiliary lever 10 has formed therewith at the lower end thereof a projection 10*a* which is engaged with one end of a link 12. The auxiliary lever has formed therewith at the upper end thereof a wedge-shaped projection 10*b* which extends at a right angle to the lever, and the upper end surface of wedge-shaped projection 13*a* similar to the wedge-shaped projection 10*b* is engaged with the lower end surface of the projection 10*b*. A return spring 14 is disposed between the rear end of the rod 13 and the governor body 4, and the rod 13 is urged to the left in the drawing by the resilient force of the return spring 14 so that the lower end of the auxiliary lever 10 is rotated in the direction as designated by an arrow *c* through the projections 13*a* and 10*b* (FIG. 1).

The link 12 is rotatably held at the intermediate portion thereof by a fulcrum 15 secured to the governor body 4. The link 12 is engaged at one end thereof with the lower end of the auxiliary lever 10 and has formed therewith at the other end thereof a horseshoe shaped long groove element 12*a* which is engaged with a lower fulcrum 17 provided at the lower end of the floating lever 16 the upper end of which is connected to the fuel control rod 2 of the fuel injection pump.

The floating lever 16 serves to move the fuel control rod 2 in the directions as shown by the arrows *a* and *b*. As aforementioned, the lever 16 is connected at the upper end thereof to the fuel control rod 2 and at the lower end to the long groove 12*a* of the link 12, and also is rotatably connected to the intermediate portion of a guide lever 19 by a pin 18. A starting spring 20 is held in tension between the uppermost end of the lever 16 and the fuel injection pump body 1. This starting spring 20 serves to exert a force on the floating lever 16 so as to move the fuel control rod 2 in the direction as shown by the arrow *a* thereby increasing the amount of fuel to be injected by the fuel injection pump.

In the operation of the governor thus constructed, the link 12 rotates about the fulcrum 15 so as to move the lower end fulcrum of the floating lever 16, and the load or resilient force of the spring 14 is exerted onto the link 12 so as to rotate the link 12 in the direction as shown by the arrow *c*. This resilient force of the spring 14 in the direction of arrow *c* serves to move the lower end fulcrum 17 of the floating lever 16 similarly in the direction as shown by the arrow *d* in FIG. 1, and accordingly acts to rotate the floating lever 16 about the pin 18 as a fulcrum in the direction as shown by the arrow *e* in FIG. 1 thereby moving the fuel control rod 2 in the direction shown by the arrow *b* to reduce the amount of fuel to be injected by the fuel injection pump.

Figure 3:
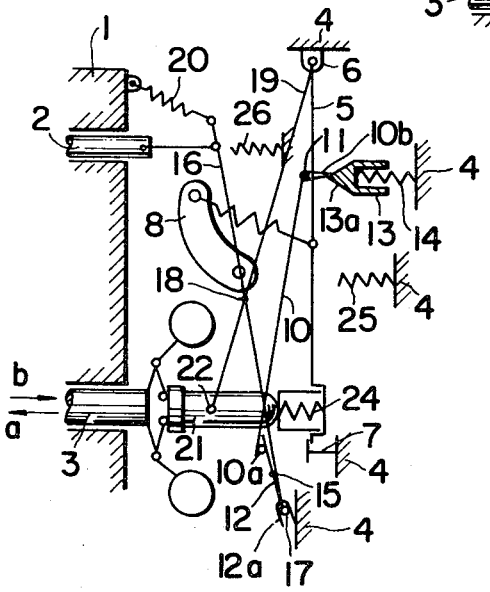
Figure 4:
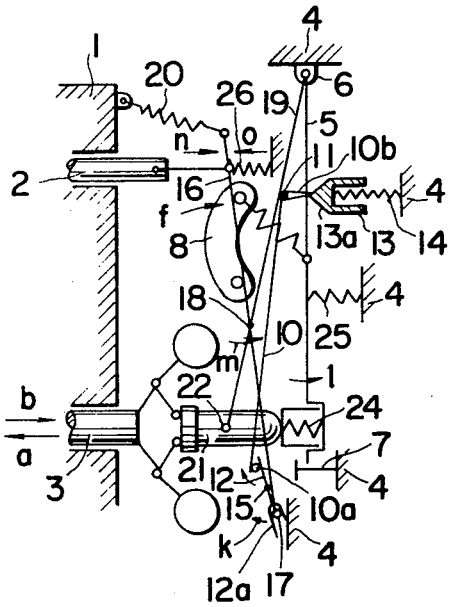

On the other hand, the load or the resilient force of the starting spring 20 serves to rotate the floating lever 16 about the pin 18 as a fulcrum in the direction opposite to that as shown by the arrow *e* in FIG. 1, and consequently acts to rotate the link 12 in the direction opposite to the direction shown by the arrow *d* in FIG. 1. Thus, the link 12 is operated depending on the resilient forces of the return spring 14 and the starting spring 20, but here it is so arranged that the resilient force of the start spring 20 becomes larger so that the end of the long groove 12*a* of the link 12 is normally engaged with the governor body 4 as shown in FIGS. 1, 3 and 4.

The aforementioned resilient force of the return spring 14 exerting on the link 12 may also be provided, without using the rod 13 as mentioned above, by holding the auxiliary lever 10 by the fulcrum 11 at the intermediate portion thereof and allowing the return spring 14 to act to the upper end of the lever 10, or by dispensing with the auxiliary lever 10 and allowing the return spring 14 to directly act on the link 12, or in other words, by arranging the structure such that the lower end fulcrum 17 of the floating lever 16 is moved in such a direction as to reduce the amount of fuel injection.

As mentioned hereinbefore, the guide lever 19 is connected at the intermediate portion thereof to the intermediate portion of the floating lever 16 by the pin 18. Further, the guide lever 19 is rotatably suspended at the upper end thereof by the pin 6 together with the locking lever 5 and is connected at the lower end thereof to a block 21 by a pin 22.

The block 21 is connected at one end thereof to weights 23 which are adapted to open by centrifugal force depending on the rotating speed of the camshaft 3 connected with the fuel injection pump and to generate a thrust so that the block can be moved in a lateral direction by the weight 23. The block 21 faces at the end thereof, the adaptor spring 24 fitted to the lower end of the rocking lever 5. Reference numeral 25 indicates an idle spring which is disposed opposite to the thrust of the weights 23 relative to the rocking lever 5, with the idle spring serving to govern the speed of the engine during low idling operation.

Reference numeral 26 shows a damper spring which is disposed opposite to the upper end of the floating lever 16 or near the portion of the lever 16 connected to the fuel control rod 2 so as to exert a resilient force onto the floating lever 16 depending on the position of the latter, and further when the resilient force is exerted, this force serves to rotate the fuel control rod 2 in the direction shown by the arrow *a* to increase the amount of fuel injection, and also rotate the link 12 in the direction opposite to the arrow *d* in FIG. 1.

In the operation of thus constructed governor, when the engine is running in a low idling condition, the lever 8 is turned in the direction as shown by the arrow *f* in FIG. 1 so as to be kept in the condition shown in FIG. 1. In such condition, the tension of the governing spring 9 is reduced, idle spring 25 exerts its resilient force against the thrust of the weight 23 through the rocking lever 5, and thus the engine speed is governed to keep its balance at the point A of the graph in FIG. 5. However, in FIG. 5, the abscissa represents the number of rotations N of the engine or camshaft 3, while the ordinate indicates the position R*w* of the fuel control rod 2 wherein the upper positions in the graph show increases in the amount of fuel. At that time, the resilient force of the starting spring 20 is larger than that of the return spring 14, and further the acting force of the damper spring 26 is additionally applied, so that the leading end of the long groove 12*a* is engaged with the governor body 4.

Figure 2:
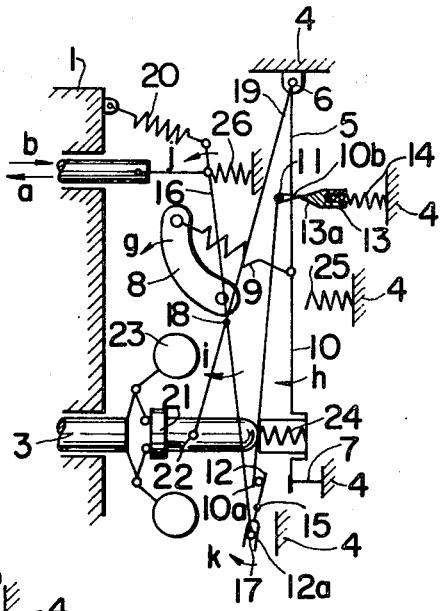
FIGS. 2 to 4 are views for illustrating the operation of the governor of the invention in various operating conditions and FIG. 5 is a graph showing the control characteristics of the governor and for illustrating the operation thereof.

Then, when the engine is accelerated from the low idling operation, the accelerator lever (not shown) is rotated so that the lever 8 is turned in the direction as shown by the arrow *g* in FIG. 2 so as to be kept in the condition shown in FIG. 2. Thus, the tension of the governing spring 9 is increased, and the rocking lever 5 is rotated in the direction as shown by the arrow *h* in FIG. 2 until the lower end thereof comes into contact with the full load stopper 7.

The rotation of the rocking lever 5 causes the leftward movement of the block 21 so as to rotate the guide lever 19 in the direction shown by the arrow *i* in FIG. 2 and also rotate the pin 18 in the same direction. Then, a force is exerted to the part of pin 18 at the floating lever 16, in the direction shown by the arrow *i*. This force rotates the floating lever 16 about the lower end fulcrum 17 in the direction as shown by the arrow *j* in FIG. 2, and at the same time acts to rotate the link 12 through the lower end fulcrum 17 of the floating lever 16 in the direction as shown by the arrow *d* in FIG. 1. Further, the biasing force of the damper spring 26 exerted on the floating lever 16 is removed and at the same time the biasing force of the start spring 20 is reduced so that the link 12 is rotated about the fulcrum 15 in the direction as shown by *d* in FIG. 1, and the lower end fulcrum 17 of the floating lever 16 is also moved in the direction as shown by the arrow *k* in FIG. 2. That is, the floating lever 16 is once moved in parallel to be placed in the condition as shown in FIG. 2, and thereafter the biasing force of the starting spring 20 to the floating lever 16, that is the biasing force to the link 12, is reduced. However, since the load of the starting spring 20 is set to be larger than the resilient force of the return spring 14, the link 12 is gradually rotated in the direction opposite to the arrow *d* in FIG. 1 so that the leading end of the long groove 12*a* is engaged with the governor body 4 as shown in FIG. 3, and simultaneously the floating lever 16 is rotated about the pin 18 in the direction as shown by the arrow *j* in FIG. 2, and the fuel control rod 2 is moved in the direction as shown by the arrow *a* so as to be placed in the full load or high speed condition of the engine.

Figure 5:
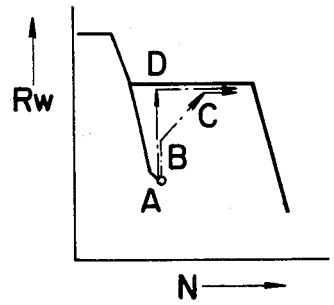

Referring now to FIG. 5 which is an explanatory view of the operation of the governor according to the present invention, the engine is operated in low idling condition keeping its balance at point A, as aforementioned. When the floating lever 16 is moved in parallel to the condition shown in FIG. 2, the fuel control rod 2 is abruptly moved from point A to B, and then the link 12 is gradually rotated in the direction opposite to the arrow *k* in FIG. 2, and the floating lever 16 is also rotated, gradually about the pin 18 in the direction as designated by the arrow *j* in FIG. 2 so that the fuel control rod 2 is moved from the point B to C as shown by two-dotted lines so as to be placed in the full load condition. The above-mentioned operation prevents sharp increases in the amount of fuel to be injected by the fuel injection pump, that is, the supply of fuel in an excess amount, when the engine is quickly accelerated. This can be readily understood from the fact that, in the conventional governor in which the lower fulcrum 17 of the floating lever 16 is secured to the governor body 4, when the engine is quickly accelerated, the fuel control rod 2 is quickly moved from the point A to D as shown by the one-dotted line in FIG. 5 to be placed in a full load condition.

The state of variation of A, B and C in FIG. 5 in the aforementioned operation of the governor can be altered by changing the load of the return spring 14 so as to obtain the optimum running condition of the engine.

Next, when the engine is in a full load condition, the floating lever 16 becomes stable in the state shown in FIG. 3 in such a manner that the floating lever 16 is rotated about the fulcrum 18 so as to engage the leading end of the groove 12*a* with the governor body 4 in a similar manner as the operation in a low idling condition except that the speed governing is effected by the governing spring 9.

Further, when the engine is decelerated from the full load condition, since the lever 8 is turned in the direction as shown by the arrow *f* in FIG. 4 so as to be placed in the condition shown in FIG. 4, the tension of the governing spring 9 is reduced so that the rocking lever 5 is rotated by the thrust of the weights 23 in the direction as shown by *l* in FIG. 4, and at the same time the guide lever 19 is rotated in the direction as shown by *m* in FIG. 4, and the pin 18 is also moved in the same direction. Therefore, the upper end of the floating lever 16 is drawn in the direction as shown by the arrow *n* in FIG. 4, and further the lower fulcrum 17 of the floating lever 16 is slightly moved in the direction as shown by the arrow *k* in FIG. 4. At that time, the damper spring 26 is engaged with the upper end of the floating lever 16, and yet by the acting force of the direction as shown by the arrow *o* in FIG. 4 exerted on the upper end of the floating lever 16, the movement of the lower fulcrum 17 of floating lever 16 in the direction as shown by the arrow *k* in FIG. 4 is restricted so that there does not occur any trouble in actual application the result is that the link 12 is rotated to engage the end of the long groove 12*a* with the governor body 4. Accordingly, when the engine is decelerated, the lower fulcrum 17 of the floating lever 16 is held in a nearly fixed condition, and the amount of fuel injected by the fuel injection pump is quickly reduced.

In the case where the damper spring 26 is not provided, since the movement of the lower fulcrum 17 of the floating lever 16 in the direction as shown by the arrow *k* in FIG. 4 is limited only by the starting spring 20, this limitation is reduced, so that the floating lever 16 is drawn more than that required at the upper end in the direction as shown by the arrow *n* in FIG. 4 resulting in reducing the amount of fuel injected by the fuel injection pump exceeding that required and thus stopping the engine accidentally.

As is clear from the foregoing, since the governor according to the present invention is advantageous in that not only the sharp increase of the amount of fuel injected by the fuel injection pump is prevented by moving the lower fulcrum 17 of the floating lever 16 when the engine is quickly accelerated, but also the lower fulcrum 17 of the floating lever 16 is kept in a stationary state at a predetermined position in other operating conditions of the engine, thereby preventing the engine from exhausting black smoke.

In the present invention, the load of the damper spring 26 to be set and its position opposite to the floating lever 16 may be properly selected.

It should be understood from the foregoing that since the governor according to the present invention is provided with a link 12 adapted to move the lower fulcrum of the floating lever 16, said link being rotated only when the engine is accelerated but being prevented from rotating by the damper spring 26 disposed opposite to the floating lever 16 when the engine is in other operating conditions and particularly when it is decelerated, so that when the engine is quickly accelerated, a sharp increase in the amount of fuel injected by the fuel injection pump is prevented so as to preclude the engine from exhausting black smoke, and the prevention of black smoke can be achieved without affecting other operating conditions of the engine. In addition, the fact that the governor according to the present invention can be obtained by simply improving a conventional governor is one of the great merits of the present invention.

What is claimed is:

1. A governor for controlling a fuel control rod in a fuel injection pump, comprising a fuel injection pump body with the fuel control rod reciprocally extending therefrom and therein;

a. a cam shaft reciprocally extending from said pump body;

b. a governor body located in spaced relation to said pump body;

c. a rocking lever suspended from and within said governor body;

d. a floating lever connected to the fuel control rod, said floating lever having a pin located intermediate thereof, and a lower fulcrum at the lowest end thereof;

e. a link engaged with the lower fulcrum of said floating lever for moving the same, said link having a fulcrum located intermediate thereof;

f. an auxiliary lever extending from an upper fulcrum in said governor body to said link and is engaged with said link at one end thereof;

g. a guide lever extending from said governor body and is connected to said floating lever at intermediate portion thereof;

h. a starting spring connected to said floating lever and adapted to exert a force to move said floating lever in such a direction as to increase the amount of fuel to be injected by said fuel injection pump;

i. a damper spring disposed in opposition to said floating lever and adapted to bias said floating lever in the same direction as that of said starting spring;

j. a return spring connected to said auxiliary lever and adapted to exert a force to move the lower fulcrum of said floating lever in such a direction as to reduce the amount of fuel to be injected by said fuel injection pump;

k. means for moving said floating lever in parallel so as to push the fuel control rod in said fuel injection pump when the engine is accelerated abruptly; and l. means for rotating said floating lever about said pin in such a direction as to increase the amount of fuel to be injected after said floating lever is moved in parallel.

2. The governor as defined in claim 1 and further comprising a governing spring extended between said rocking lever and a lever connected to an accelerator lever of the engine.

3. The governor as defined in claim 1, wherein the lower fulcrum is engaged by a groove element, which partially encircles the lower fulcrum and to which the lower end of said floating lever is attached and wherein said groove element is formed integrally with said link.

4. The governor as defined in claim 1 wherein an idle spring is disposed between said governor body and said rocking lever.

5. The governor as defined in claim 1, wherein a block is connected at one end to said cam shaft and at the other end to an adaptor spring connected to the lower end of said rocking lever.

6. The governor as defined in claim 1, wherein the spring force of said starting spring is larger than that of said return spring.

7. The governor as defined in claim 5, wherein said guide lever is connected to said block.

* * * * *

UNITED STATES PATENT OFFICE

CERTIFICATE OF CORRECTION

Patent No. 3,973,541 Dated August 10, 1976

Inventor(s) Yoshiatsu Nakamura et al

It is certified that error appears in the above-identified patent and that said Letters Patent are hereby corrected as shown below:

[73] Assignee: NIPPONDENSO CO., LTD., Aichi, Japan
and
Kabushiki Kaisha Komatsu Seisakusho,
Tokyo, Japan Signed and Sealed this Fourteenth Day of December 1976

[SEAL]

*Attest:*

RUTH C. MASON
*Attesting Officer*

C. MARSHALL DANN
*Commissioner of Patents and Trademarks*